US006144831A

United States Patent [19]

Takenouchi et al.

[11] Patent Number: 6,144,831

[45] Date of Patent: Nov. 7, 2000

[54] IMAGE FORMING APPARATUS AND METHOD

[75] Inventors: Katsuya Takenouchi; Yasushi Kawahata; Nobuyoshi Komatsu; Keiji Yamamoto; Noriaki Kojima; Yukio Hayashi; Takashi Kawabata; Nobuo Hyakutake; Makoto Katayama; Masao Ohkubo, all of Ebina, Japan

[73] Assignee: Fuji Xerox Co., Ltd., Tokyo, Japan

[21] Appl. No.: 09/251,343

[22] Filed: Feb. 17, 1999

[30] Foreign Application Priority Data

Feb. 19, 1998 [JP] Japan ..... 10-037239
Mar. 10, 1998 [JP] Japan ..... 10-058386

[51] Int. Cl.[7] ..... G03G 15/16

[52] U.S. Cl. ..... 399/302; 399/313

[58] Field of Search ..... 399/302, 308, 399/313, 314, 398

[56] References Cited

U.S. PATENT DOCUMENTS 5,189,478 2/1993 Hara et al. .
5,357,330 10/1994 Hauser .
5,838,456 11/1998 Wagi et al. ..... 358/300
5,890,030 3/1999 Namekata et al. ..... 399/66

FOREIGN PATENT DOCUMENTS 6-149074 5/1994 Japan .
B2-8-23719 3/1996 Japan .

*Primary Examiner*—Richard Moses
*Attorney, Agent, or Firm*—Oliff & Berridge, PLC

[57] ABSTRACT

An image forming apparatus includes: a transfer unit T2 including the inside transfer roll 29, the outside transfer roll 30 transfers the toner image from the toner image holding belt B onto the recording sheet that passes through the transfer region Q4 when transfer voltage is applied to between the inside transfer roll 29 and the outside transfer roll 30; electric-field adjusting conductive member 51 disposed in proximity to and along the inner side of the toner image holding belt B leaving the transfer region Q4 at a position located downstream of the transfer region Q4; and electric-field adjust-potential applying means 53; 54 applies a potential, which weakens an electric field developed between the outside transfer roll 30 and the inside transfer roll 29 in a region located downstream of the transfer region Q4, to the electric-field adjusting conductive member 51.

9 Claims, 9 Drawing Sheets

IMAGE FORMING APPARATUS AND METHOD

BACKGROUND OF THE INVENTION

The present invention relates to an image forming apparatus provided with a toner image holding belt, such as a photosensitive belt into which an electrostatic latent image to be developed into a toner image is written or an intermediate transfer belt onto which a toner image is primarily transferred from a toner image holding member.

The conventional image forming apparatus suffers from such problems as paper jam and image disarray, which arise from the fact that after passing an image transfer region, a recording medium, e.g., recording sheet, is not separated from an intermediate transfer belt and hence not transported to a fixing stage.

For the cause of the sheet clinging problem, it may be estimated that the recording sheet charged through the image transfer process is attracted to the toner image holding belt under a transfer electric field.

The following techniques (J01) and (J02), so far as we know, may be enumerated for the techniques for solving the poor-separation problem of the recording sheet having received a toner image from the toner image holding belt.

(J01) Technique disclosed in the Unexamined Japanese Patent Application Publication No. Hei 6-149074.

A sheet charge-removal member is located downstream of an image transfer stage for transferring a toner image onto the recording sheet, viz., between the recording-sheet holding the toner image and the photosensitive belt.

(J02) Technique disclosed in the Unexamined Japanese Patent Application Publication No. Hei 8-23719.

A separation plate consisting of an earth metal plate and an insulation shield plate, located downstream of a transfer stage for transferring a toner image to the recording sheet and on the sheet exit side of the transfer roller. The insulation shield plate is brought into contact with the earth metal plate from the transfer roller side and projected toward the transfer stage.

Those techniques have the following problems.

1) Problems of (J01)

The (J01) technique prevents the recording sheet from being electrostatically attracted to the photosensitive belt, by removing the charge from the recording sheet. The charge removal member is placed in proximity to the photosensitive belt and performs a discharging operation. The discharging operation adversely affects the electric characteristics of the photosensitive belt, and the products by the discharging operation attach to the photosensitive belt.

2) Problems of (J02)

The (J02) technique pushes the recording sheet in the direction in which the sheet moves apart from the toner holding belt by the utilization of the charge of the recording sheet per se. In case where the recording sheet used is a paper, not rigid, e.g., a thin paper containing water at high percentage, the separated sheet hangs down, so that the tip of the sheet comes in contact with the separation plate, resulting in paper jam and image disarray.

Accordingly, the present invention has the following objects:

(O01) to stably separate the recording sheet from the toner image holding belt, not using the charge remover requiring a high tension power source;

(O02) to stably separate the recording sheet from the toner image holding belt, not locating a member that possibly obstructs the transportation of the recording sheet on the sheet transporting path; and (O03) to stably separate the recording sheet from toner image holding belt independently of ambient conditions and sheet characteristics.

In the description of the "means to solve the problems", which is to be given below, reference symbols attached to portions are parenthesize for ease understanding of their correspondence to those in the "description of the preferred embodiments" to be given later.

It should be understood that the use of the parenthesize symbols does not limit the scope of the invention in any way.

SUMMARY OF THE INVENTION

<First Image Forming Method>

To solve the above problems, according to an aspect of the invention, there is provided a first image forming method comprising the steps of:

developing a toner image on a photosensitive member;

forming a toner image on a toner image holding belt rotatably supported by a plural number of rolls including an inside transfer roll;

moving a recording sheet through a transfer region when a toner image on said toner image holding belt passes through said transfer region;

transferring the toner image from said toner image holding belt onto the recording sheet passing through said transfer region when voltage is applied to between said inside transfer roll and an outside transfer member, which is disposed in opposition to said inside transfer roll with respect to said toner image holding belt; and weakening an electric field developed between said outside transfer member and said inside transfer roller in a region located downstream of said transfer region, after the recording sheet passes through said transfer region.

<First Image Forming Apparatus>

To solve the above problems, according to an aspect of the invention, there is provided a first image forming apparatus comprising:

(A01) a toner image holding belt rotatably supported by a plural number of rolls (25 to 29) including an inside transfer roll (29), a toner image being formed on the surface of the toner image holding belt (B);

(A02) an outside transfer member (30), which is disposed in opposition to the inside transfer member (29) with respect to the toner image holding belt (B) develops a transfer region (Q4) in a space between the outside transfer member (30) and the toner image holding belt (B);

(A03) sheet transport means (42 to 47) for moving a recording sheet through the transfer region (Q4) when a toner image on the toner image holding belt (B) passes through the transfer region (B);

(A04) a transfer unit (T2) including the inside transfer member (29), the outside transfer member (30) transfers the toner image from the toner image holding belt (B) onto the recording sheet that passes through the transfer region (Q4) when transfer voltage is applied to between the inside transfer member (29) and the outside transfer member (30);

(A05) electric-field adjusting conductive member (51) disposed in proximity to and along the inner side of the toner image holding belt (B) leaving the transfer region (Q4) at a position located downstream of the transfer region (Q4); and (A06) electric-field adjust-potential applying means (53; 54) applies a potential, which weakens an electric field developed between the outside transfer member (30) and the inside transfer member (29) in a region located downstream of the transfer region (Q4), to the electric-field adjusting conductive member (51).

<Operation of the First Image Forming Apparatus>

In the thus constructed first image forming apparatus, a toner image is formed on the surface of the intermediate transfer belt (B), which is rotatably supported by the support rollers including the inside transfer member (29).

The outside transfer member (30), which is disposed in opposition to the inside transfer member (29) with respect to the toner image holding belt (B) develops a transfer region (Q4) in a space between the roll (30) and the toner image holding belt (B).

The sheet transport means (42 to 47) moves the recording sheet through the transfer region (Q4) when the toner image on the toner image holding belt (B) passes through the transfer region (Q4).

The transfer unit (T2) including the inside transfer member (29), the outside transfer member (30) and the electrode roll (31) transfers the toner image from the toner image holding belt (B) onto the recording sheet that passes through the transfer region (Q4) when transfer voltage is applied to between the inside transfer member (29) and the outside transfer roll (30).

The electric-field adjust-potential applying means (53; 54) applies a potential, which weakens the electric field developed between the outside transfer member (30) and the inside transfer roll (29) in a region located downstream of the transfer region (Q4). to the electric-field adjusting conductive member (51) is disposed in proximity to and along the inner side of the toner image holding belt (B) leaving the transfer region (Q4) at a position located downstream of the transfer region (Q4).

Therefore, the electric field acting to move the recording sheet leaving the transfer region (Q4) to the toner image holding belt (B) is weakened, and hence there is a little chance that the paper jam is caused by the clinging of the recording sheet to the toner image holding belt (B).

<Second Image Forming Apparatus>

According to another aspect of the present invention, there is provided a second image forming apparatus comprising:

(B01) a toner image holding belt rotatably supported by a plural number of rolls (25 to 29) including an inside transfer roll (29), a toner image being formed on the surface of the toner image holding belt (B);

(B02) an outside transfer member (30), which is disposed in opposition to the inside transfer roll (29) with respect to the toner image holding belt (B) develops a transfer region (Q4) in a space between the outside transfer member (30) and the toner image holding belt (B);

(B03) sheet transport means (42 to 47) for moving a recording sheet through the transfer region (Q4) when a toner image on the toner image holding belt (B) passes through the transfer region (B);

(B04) a transfer unit (T2) including the inside transfer roll (29), the outside transfer member (30) transfers the toner image from the toner image holding belt (B) onto the recording sheet that passes through the transfer region (Q4) when transfer voltage is applied to between the inside transfer roll (29) and the outside transfer member (30);

(B05) electric-field adjusting conductive member (55) for adjusting an electric field present upstream of the transfer region (Q4), the electric-field-adjust conductive member (55) being disposed in proximity to and along the inner side of the toner image holding belt (B) just before the transfer region (Q4); and (B06) electric-field adjust-potential applying means (57) applies a potential, which weakens an electric field developed between the outside transfer member (30) and the inside transfer roll (29) in a region located upstream of the transfer region (Q4), to the electric-field adjusting conductive member (55).

<Operation of the Second Image Forming Apparatus>

The electric-field adjust-potential applying means (57) applies a potential, which weakens an electric field developed between the outside transfer member (30) and the inside transfer roll (29) in a region located upstream of the-transfer region (Q4), to the electric-field adjusting conductive member (55) which is disposed in proximity to and along the inner side of the toner image holding belt (B) before it enters the transfer region (Q4)

Therefore, the electric field acting to scatter toner particles on the toner image holding belt (B) before it enters the transfer region (Q4) is weakened, so that the toner configuration on the intermediate transfer belt (B) is less disarrayed.

<Third Image Forming Apparatus>

According to a further aspect of the invention, there is provided a third image forming apparatus comprising:

(C01) a toner image holding belt (B) rotatably supported by a plural number of rolls (25 to 29) including an inside transfer roll (29), a toner image being formed on the surface of the toner image holding belt (B);

(C02) an outside transfer member (30), which is disposed in opposition to the inside transfer roll (29) with respect to the toner image holding belt (B) develops a transfer region (Q4) in a space between the outside transfer member (30) and the toner image holding belt (B);

(C03) sheet transport means (42 to 47) for moving a recording sheet through the transfer region (Q4) when a toner image on the toner image holding belt (B) passes through the transfer region (Q4);

(C04) a transfer unit (T2) including the inside transfer roll (29) and the outside transfer member (30) transfers the toner image from the toner image holding belt (B) onto the recording sheet that passes through the transfer region (Q4) when transfer voltage is applied to between the inside transfer roll (29) and the outside transfer member (30);

(C05) elastic, electric-field adjusting conductive member (51) for adjusting an electric field present downstream of the transfer region (Q4), the electric-field-adjust conductive member (51) being disposed in contact with or in proximity to and along the inner side of the toner image holding belt (B) leaving the transfer region (Q4) at a position located downstream of the transfer region (Q4); and (C06) electric-field adjust-potential applying means (53) applies a potential, which weakens an electric field developed between the outside transfer member (30) and the inside transfer roll (29) in a region located downstream of the transfer region (Q4), to the electric-field adjusting conductive member (51).

<Operation of the Third Image Forming Apparatus>

In the thus constructed third image forming apparatus, a toner image is formed on the surface of the intermediate transfer belt (B), which is rotatably supported by the support rollers including the inside transfer roll (29).

The outside transfer member (30), which is disposed in opposition to the inside transfer roll (29) with respect to the toner image holding belt (B) develops a transfer region (Q4) in a space between the roll (30) and the toner image holding belt (B).

The sheet transport means (42 to 47) moves the recording sheet through the transfer region (Q4) when the toner image on the toner image holding belt (B) passes through the transfer region (Q4).

The transfer unit (T2) including the inside transfer roll (29), the outside transfer member (30) and the electrode roll (31) transfers the toner image from the toner image holding belt (B) onto the recording sheet that passes through the transfer region (Q4) when transfer voltage is applied to between the inside transfer roll (29) and the outside transfer member (30).

The electric-field adjust-potential applying means (53) applies a potential, which weakens the electric field developed between the outside transfer member (30) and the inside transfer roll (29) in a region located downstream of the transfer region (Q4), to the electric-field adjusting conductive member (51) is disposed in proximity to and along the inner side of the toner image holding belt (B) leaving the transfer region (Q4) at a position located downstream of the transfer region (Q4).

Therefore, the electric field acting to move the recording sheet leaving the transfer region (Q4) to the toner image holding belt (B) is weakened, and hence there is a little chance that the paper jam is caused by the clinging of the recording sheet to the toner image holding belt (B).

The electric-field-adjust conductive member (51) may be disposed in contact with or in proximity to and along the inner side of the toner image holding belt (B) leaving the transfer region (Q4) at a position located downstream of the transfer region (Q4). Where the electric-field-adjust conductive member (51) is used in proximity with the toner image holding belt (B), if the toner image holding belt (B) displaces and the electric-field-adjust conductive member (51) comes in contact with the latter, it does not damage the toner image holding belt (B) since the electric-field-adjust conductive member (51) is elastic.

[Specific Forms of the First to Third Image Forming Apparatus]

<Specific Form 1 of the First Image Forming Apparatus>

The first forming apparatus may further comprise:

(A07) an insulation shield member (52) covering the end of the electric-field-adjust conductive member (51), which is closer to and faces the inside transfer roll (29).

<Operation of the Specific Form 1 of the First Image Forming Apparatus>

With provision of the insulation shield member (52) covering the end of the electric-field-adjust conductive member (51), which is closer to and faces the inside transfer roll (29), no electric leakage (discharge) takes place between the electric-field-adjust conductive member (51) and the inside transfer roll (29).

<Specific Form 1 of the Second Image Forming Apparatus>

The second image forming apparatus may further comprise:

(B07) an insulation shield member (56) covering the end of the electric-field-adjust conductive member (55), which is closer to and faces the inside transfer roll (29).

<Operation of the Specific Form 1 of the Second Image Forming Apparatus>

With provision of the insulation shield member (56) covering the end of the electric-field-adjust conductive member (55), which is closer to and faces the inside transfer roll (29), no electric leakage (discharge) takes place between the electric-field-adjust conductive member (55) and the inside transfer roll (29).

<Specific Form 1 of the Third Image Forming Apparatus>

The third image forming apparatus may further comprises:

(C07) a rigid, plate-like insulating member (52), applied to the surface of the electric-field-adjust conductive member (51), which is opposite to its surface facing the image holding belt (B).

<Operation of the Specific Form 1 of the Third Image Forming Apparatus>

The plate-like insulating member (52) covers the surface of the electric-field-adjust conductive member (51), which is opposite to its surface facing the image holding belt (B). If the electric-field-adjust conductive member (51) is disposed close to the inside transfer roll (29), the plate-like insulating member (52) inhibits discharge occurrence between the electric-field-adjust conductive member (51) and the inside transfer roll (29). The rigid plate-like insulating member (52), because of its rigidity, can support the electric-field-adjust conductive member (51) at a predetermined location.

<Specific Form 2 of the Third Image Forming Apparatus>

The specific form 2 of the third image forming apparatus is defined by the third image forming apparatus or the specific form 1 of the third image forming apparatus, and further defined as follows:

(C08) the inside transfer roll (29), the outside transfer member (30) and the electric-field-adjust conductive member (51) are arranged so as to satisfy $e \leqq f$, where Pa: the upstream end of the electric-field-adjust conductive member (51), which is disposed in proximity to the inside transfer roll (29)

Pb: intersection point where a straight line L1 coincident with the advancing direction of a recording sheet emanating from the transfer region (Q4) intersects a straight line L2 that passes through the upstream end Pa and is perpendicular to the straight line L1

Pc: intersection point where the straight line L2 intersects the image holding belt (B);

e: distance between the upstream end Pa and the intersection point Pc f: distance between the intersection point Pb and the intersection point Pc.

<Operation of the Specific Form 2 of the Third Image Forming Apparatus>

In the specific form 2 of the third image forming apparatus, the inside transfer roll (29), the outside transfer member (30) and the electric-field-adjust conductive member (51) are arranged so as to satisfy $e \leqq f$, where Pa: the upstream end of the electric-field-adjust conductive member (51), which is disposed in proximity to the inside transfer roll (29)

Pb: intersection point where a straight line L1 coincident with the advancing direction of a recording sheet emanating from the transfer region (Q4) intersects a straight line L2 that passes through the upstream end Pa and is perpendicular to the straight line L1

Pc: intersection point where the straight line L2 intersects the image holding belt (B);

e: distance between the upstream end Pa and the intersection point Pc f: distance between the intersection point Pb and the intersection point Pc.

In a situation where the recording sheet leaves and advances along the straight line L1 and its leading edge reaches the straight line L2, the distance between the leading edge of the recording sheet and the toner image holding belt (B) is longer than the distance between the toner image holding belt (B) and the electric-field-adjust conductive member (51). Where the toner image holding belt (B) is charged, the charge of electricity migrates through the shorter space between the toner image holding belt (B) and the electric-field-adjust conductive member (51). Therefore, an electric field present in the longer space (i.e., between the leading edge of the recording sheet and the toner image holding belt (B)) is small.

Under this condition, a small electrostatic force exerts on the recording sheet, from the toner image holding belt (B), and hence the toner image holding belt (B) is hard to attract the recording sheet to it.

<Specific Form 3 of the Third Image Forming Apparatus>

The specific form 3 of the third image forming apparatus is defined by the third image forming apparatus or the specific form 1 or 2 of the third image forming apparatus, and may further comprise:

(C09) a downstream sheet guide (46), disposed downstream of the transfer region (Q4), for guiding a recording sheet leaving the transfer region (Q4), and the specific form 3 is defined as (C10) the inside transfer roll (29), the outside transfer member (30), the electric-field-adjust conductive member (51), and the downstream sheet guide (46) are arranged so as to satisfy $h \leqq g$, where P1: intersection point where the straight line L1 coincident with the advancing direction of the recording sheet emanating from the transfer region (Q4) intersects a straight line L3 which is prolonged from the downstream end of the electric-field-adjust conductive member (51), which is far away from the inside transfer roll (29), in the direction perpendicular to the straight line L1

P2: intersection point where the straight line L3 intersects the image holding belt g: distance between the intersection points P1 and P2.

h: distance between the intersection points P1 and P3.

<Operation of the Specific Form 3 of the Third Image Forming Apparatus>

In the specific form 3 of the third image forming apparatus, the downstream sheet guide (46), disposed downstream of the transfer region (Q4), guides a recording sheet leaving the transfer region (Q4).

The inside transfer roll (29), the outside transfer member (30), the electric-field-adjust conductive member (51), and the downstream sheet guide (46) are arranged so as to satisfy $h \leqq g$, where P1: intersection point where the straight line L1 coincident with the advancing direction of the recording sheet emanating from the transfer region (Q4) intersects a straight line L3 which is prolonged from the downstream end of the electric-field-adjust conductive member (51), which is far away from the inside transfer roll (29), in the direction perpendicular to the straight line L1

P2: intersection point where the straight line L3 intersects the image holding belt g: distance between the intersection points P1 and P2 h: distance between the intersection points P1 and P3.

Therefore, the following merit is produced. In a situation where the recording sheet leaves and advances along the straight line L1 and its leading edge reaches the straight line L3, the distance between the leading edge of the recording sheet and the intermediate transfer belt B is longer than the distance between the leading edge of the recording sheet and the downstream sheet guide (46). Therefore, the recording sheet is under the influence of an electric field present in the shorter space between the recording sheet and the sheet guide (46) rather than an electric field present in the longer space between the recording sheet and the intermediate transfer belt B.

Therefore, there is a little chance that the intermediate transfer belt B electrostatically attracts the recording sheet to it.

BRIEF DESCRIPTION OF THE DRAWINGS

FIG. 2 is an enlarged view showing a key portion in the embodiment 1 of FIG. 1.

FIG. 8 is an explanatory diagram useful in explaining an electric-field-adjust conductive member in use with an image forming apparatus, which constitutes a fifth embodiment of the present invention.

FIG. 9 is another explanatory diagram for explaining the electric-field-adjust conductive member and its related mechanical components.

DETAILED DESCRIPTION OF THE PREFERRED EMBODIMENTS

Specific modes (embodiments) in which the present invention may be executed will be described in detail with reference to the accompanying drawings. It should be understood that the invention is not limited to such specific embodiments, but may be executed in other various modes than those specific ones to be described hereunder.

<Embodiment 1>

Figure 1:
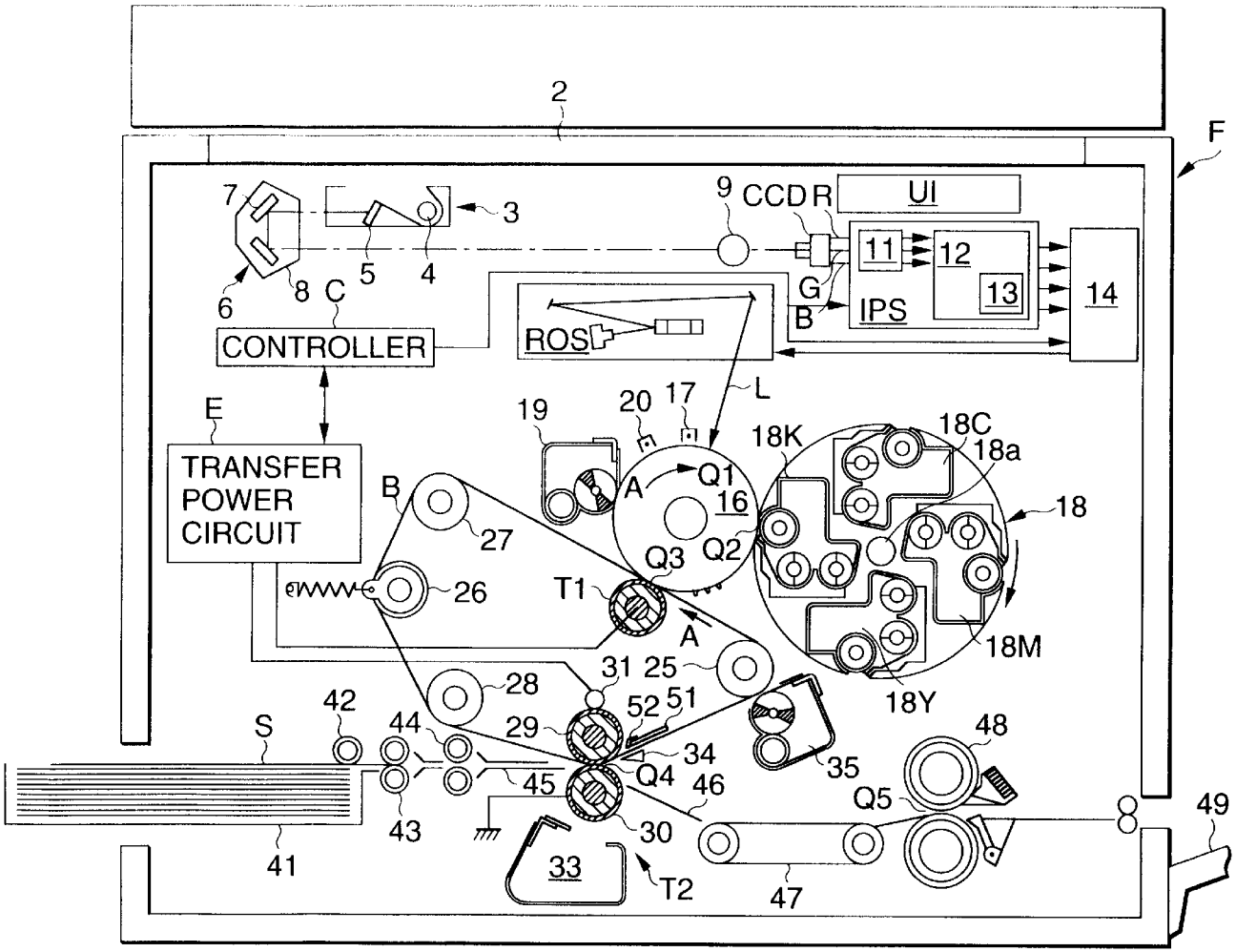
FIG. 1 is an enlarged view useful in explaining an embodiment 1 of the present invention.
Figures 2A, 2B:
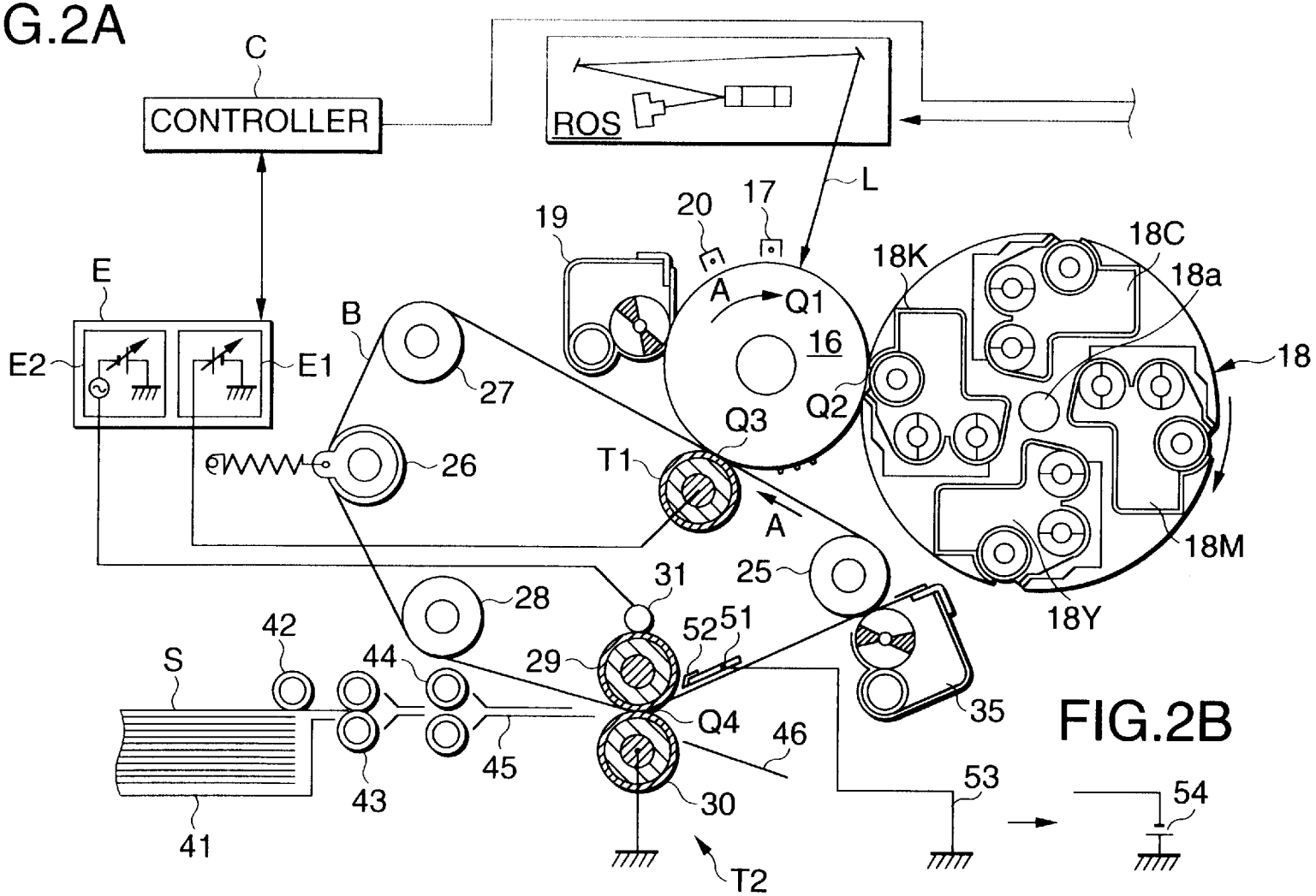
FIG. 2A is an enlarged view of a key portion of the embodiment 1.
FIG. 2B is a diagram showing a modification of an electrical connection of an electric-field adjusting conductive member in FIG. 2A.
Figure 3:
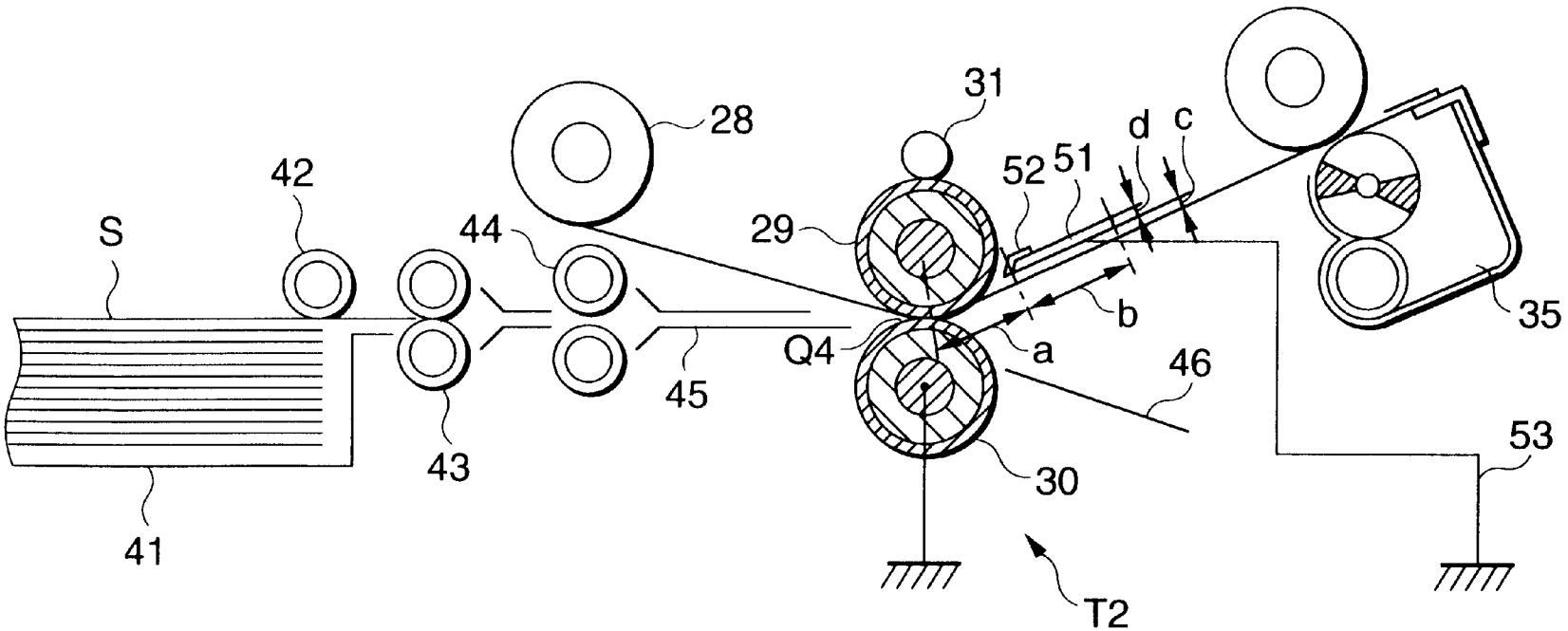
FIG. 3 is an enlarged view showing a key portion of the construction shown in FIG. 2A.

FIG. 1 is an enlarged view useful in explaining an embodiment 1 of the present invention; FIG. 2A is an enlarged view of a key portion of the embodiment 1; FIG. 2B is a diagram showing a modification of an electrical connection of an electric-field adjusting conductive member in FIG. 2A; and FIG. 3 is an enlarged view showing a key portion of the construction shown in FIG. 2A.

In FIG. 1, an image forming apparatus F includes a UI (user interface) and a platen glass 2, transparent, on which an original document (not shown) is located. The UI includes at least a copy start key, a full color mode key, ten keys, and display window (those are not shown).

When a full color mode is selected, the original located on the platen glass 2 is illuminated with a light source 4 contained in a light source unit 3. Light reflected on the original is reflected successively by a first mirror 5 of the light source unit 3, a second mirror 7 and a third mirror 8, which are contained in a mirror unit 6; passes through an imaging lens 9; hits a CCD; and the CCD in turn reads out image information of the original, contained in the received light, and produces the image information in the form of analog signals of R (red), G (green) and B (blue).

Those image signals are input to an IPS controlled by a controller C. Readout-image-information output means 11 of the IPS converts the received analog signals into corresponding digital image data signals. Image data output means 12, which includes an image memory 13, separates the digital image data into color image data of Y (yellow), M (magenta), C (cyan) and K (black); processes those color image data for at least density correction and reduction/enlargement; and produces the processed ones in the form of write image data (laser drive data).

Laser drive signal output unit 14 sequentially outputs laser drive signals which depend on the image data of Y, M, C and K sequentially received from the IPS at given timings to a ROS (raster output scan) unit (i.e., latent image forming unit). In turn, the ROS outputs a laser beam L modulated by the laser drive signals.

An image holding member 16, which is rotating in the direction of an arrow, is charged by a charger 17; at a latent image writing position Q1, an electrostatic latent image is written into the surface of the image holding member 16 by the laser beam L; at a developing region Q2, a rotary-type developing unit 18 including developing sub-units 18*k* to 18*c* of colors K (black), Y (yellow), M (magenta) and C (cyan) develop the latent image into toner images of those colors (the developing unit 18 rotates together with a rotary shaft 18*a*); at a primary transfer region Q3, the color toner images are primarily transferred onto an intermediate transfer belt (toner holding belt) B in a superimposing manner by means of a primary transfer roll (primary transfer unit) T1; and after passing the primary transfer region Q3, the image holding member 16 reaches a cleaner 20 and the cleaner removes toner left on the surface of the image holding member.

The intermediate transfer belt B are rotatably supported by belt support rolls 25 to 29; a drive roll 25, a tension roll 26, idler rolls 27 and 28, an inside secondary transfer roll (backup roll) 29.

An outside secondary transfer roll 30 is disposed in opposition to the inside secondary transfer roll 29 with respect to the intermediate transfer belt B in a state that the roll 30 is movable to a separate position apart from the inside secondary transfer roll 29 and to a close position at which the roll 30 is pressed against the roll 29, viz., the roll 30 is movable to and apart from the roll 29. An electrode roll 31 is in contact with the surface of the inside secondary transfer roll 29, while receiving a secondary transfer voltage of the same polarity as of the toner charging polarity (negative in this embodiment). The core of the outside secondary transfer roll 30 is earthed.

The inside secondary transfer roll 29, the outside secondary transfer roll 30 and the electrode roll 31 make up a secondary transfer unit T2.

The secondary transfer unit T2 secondarily transfers the toner image from the intermediate transfer belt B onto a recording sheet S passing a secondary transfer region Q4 that is defined by a nip (contact area) between the outside secondary transfer roll 30 and the intermediate transfer belt B (the toner image on the intermediate transfer belt B is a composite toner image formed by superimposing the color toner images on the intermediate transfer belt B by the primary transfer unit T1).

The voltage applied to the primary transfer unit (roll) T1 and the voltage applied to the secondary transfer unit T2 are derived from a primary transfer power circuit E1 and a secondary transfer power circuit E2 in a power supply circuit E (FIG. 2).

A roll cleaner 33 gathers toner from the surface of the outside secondary transfer roll 30. A stripper 34 and a belt cleaner 35 are located downstream of the secondary transfer region Q4 and in proximity with the intermediate transfer belt B.

A belt position sensor SN1 is provided for detecting a mark representative of a rotation position on the intermediate transfer belt B. A signal indicative of the rotation position is output from the belt position sensor SN1 is used for controlling the timing of writing an electrostatic latent image onto the image holding member 16.

Recording sheets S are picked up sheet by sheet from a paper tray 41 by means of a pick-up roll 42, and a picked up recording sheet S is temporarily stopped at a registration roll 44; and is transported from a sheet guide member 45 to the secondary transfer region Q4 at a given timing. When passing through the secondary transfer region Q4, a composite color toner image is transferred from the intermediate transfer belt B onto the recording sheet S, and the recording sheet S bearing the color toner image thereon is transported to a fixing region Q5 by means of a sheet guide (located downstream of the secondary transfer region) 46 and a sheet transport belt 47. When passing through the fixing region Q5, the color toner image (resulting from the secondary transferring operation) is fixed onto the recording sheet S by a couple of fixing rolls of a fixing unit 48, and then the recording sheet S having the color toner image fixed thereonto is discharged into a sheet receiving tray 49.

The components 42 to 47 make up a sheet transport means (42 to 47) in the embodiment 1.

<Intermediate transfer belt (toner image holding belt) B>

In the embodiment 1, the intermediate transfer belt (toner image holding belt) B is made of resin (e.g., acryl, vinyl chloride, polyester, polycarbonate, or polyimide) or rubber containing a proper amount of antistatic additive (e.g., carbon black), and 0.1 mm in thickness and $10^6$ to $10^{14}$ Ω cm in volume resistivity. When the volume resistivity is too small, a secondary transfer electric field is spread. Under this condition, an image transferring operation is performed before the secondary transfer region Q4 and in a state that the distance between the recording sheet S and the intermediate transfer belt B is large, and toner particles are scattered. When the volume resistivity is too large, a concentration of the antistatic additive in the resin or rubber of the intermediate transfer belt B is lowered. Under this condition, if it is placed under an electric field, resistance reduction of the intermediate transfer belt B, which is due to its aging, appears as degradation of the transfer performance of the belt. For this reason, it is preferable that the volume resistivity is further reduced to be within a range of $10^6$ to $10^8$ Ω cm, provided that any measure is not taken in particular.

When the intermediate transfer belt B thus adjusted to have relatively low resistance is used, the recording sheet having undergone the image transferring process is likely to be charged at the polarity that is opposite to that of the bias voltage applied to the inside secondary transfer roll 29 (The reason for this may be estimated that resistance at the transfer nip is lowered, so that the opposite polarity charge is easy to flow from the earthed outside secondary transfer roll 30 to the nip.). Therefore, when the leading edge of the recording sheet having undergone the secondary image transfer and been charged leaves the nip and advances a distance of about 10 mm ahead of the nip, the sheet enters the electric field developed between the outside secondary transfer roll 30 and the inside secondary transfer roll 29, and attaches to the intermediate transfer belt B, viz., the sheet unseparable problem arises.

<Electric-field adjusting conductive member 51 for adjusting an electric field present downstream of the secondary transfer region>

To prevent the sheet unseparable problem, an electric-field adjusting conductive member 51 is disposed in proximity to and along the inner side of the toner image holding belt B at a position located downstream of the secondary transfer region Q4. To this end, it is required that a potential to weaken an electric field that is developed between the inside secondary transfer roll 29 and the outside secondary transfer roll 30 in a region located downstream of the secondary transfer region Q4 is applied to the electric-field adjusting conductive member 51. In the embodiment 1, the electric-field adjusting conductive member 51 is earthed via a conductive member 53 since the outside secondary transfer roll 30 is earthed as shown. In the embodiment, the conductive member 53 for earthing the electric-field adjusting conductive member 51 forms electric-field adjusting-potential applying means.

Thus, the embodiment reduced the electric field formed downstream of the secondary transfer region Q4 by keeping the electric-field adjusting conductive member 51 at a potential substantially equal to that of the outside secondary transfer roll 30, whereby preventing the recording sheet from being pulled toward the intermediate transfer belt B (inside secondary transfer roll 29).

In FIG. 2, to transfer the negatively charged toner image from the intermediate transfer belt B to the recording sheet S, a negative DC voltage (bias), e.g., −2 kV, is applied to the surface of the inside secondary transfer roll 29 by way of the electrode roll 31, and the core (metal shaft) of the outside secondary transfer roll 30 as the opposite electrode is earthed, whereby a secondary transfer electric field is developed.

Figure 4:
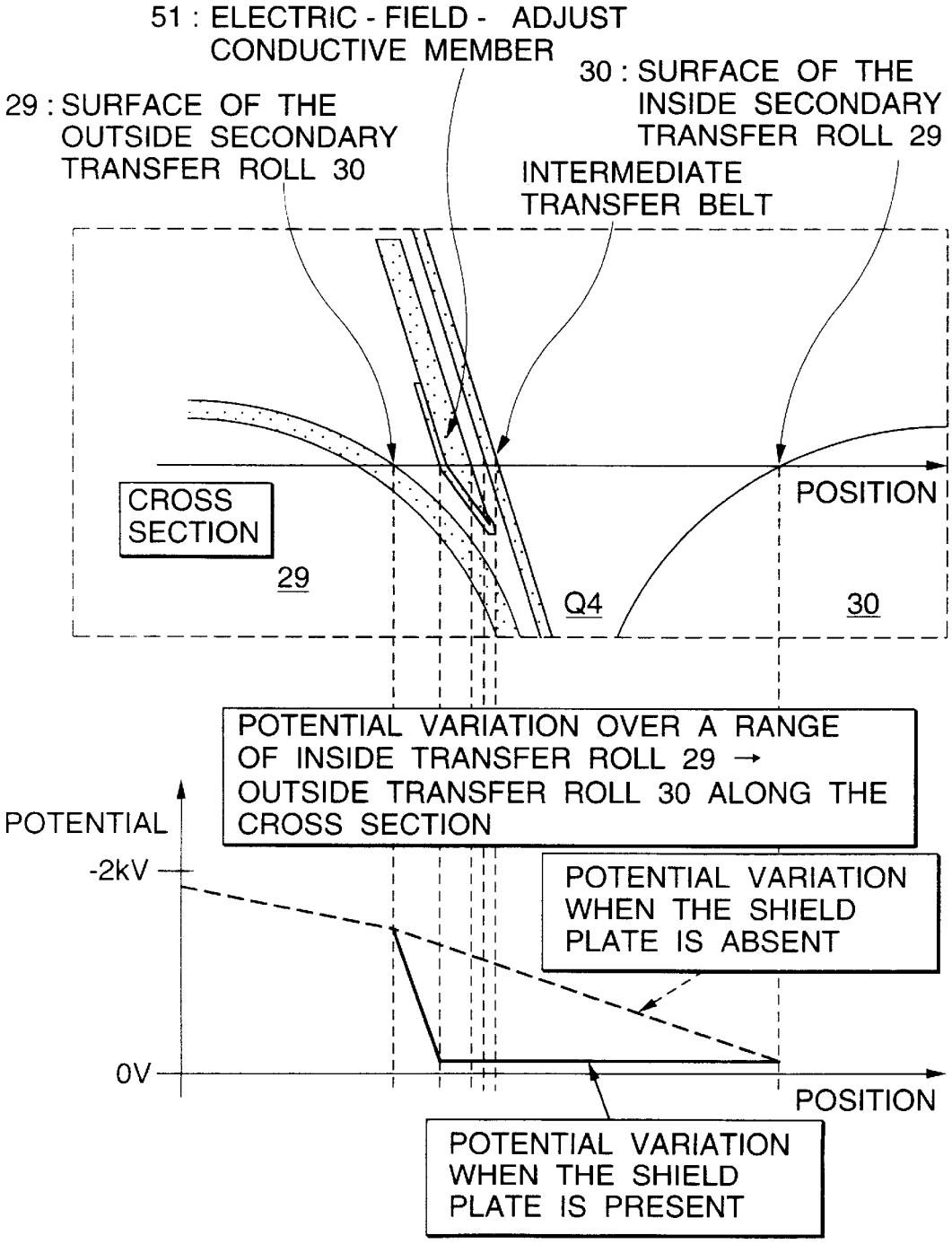
FIG. 4 is a line graph showing a model of a potential variation ranging from the surface of an inside secondary transfer roll to the surface of an outside secondary transfer roll.

FIG. 4 is a line graph showing a model of a potential variation ranging from the surface of the inside secondary transfer roll 29 to the surface of the outside secondary transfer roll 30.

A model of a "potential variation over a range of inside transfer roll 29→outside transfer roll 30 along the cross section" in the graph illustrated in the lower part of FIG. 4 was depicted by plotting potential values distributed along a transverse line (bold line) with an arrow head in the "cross section" illustrated in the upper part of FIG. 4.

As shown, a point where the traverse line crosses the surface of the inside secondary transfer roll 29 is at a potential of several hundreds volt since −2 kV at the contact of the inside secondary transfer roll 29 with the electrode roll 31 potential is dropped by creeping resistance of the inside secondary transfer roll 29 per se.

The surface of the outside secondary transfer roll 30 is at—several tens to several hundreds V even at the secondary transfer region (transfer nip) Q4 where the outside secondary transfer roll 30 and the inside secondary transfer roll 29 cooperate to press together the intermediate transfer belt B and the recording sheet. When the surface of the outside-secondary transfer roll 30, with its turn, leaves the secondary transfer region Q4, the charge in its surface rapidly flows into the shaft of the earthed outside secondary transfer roll 30, and the potential at a point where the traverse line crosses the surface of the outside secondary transfer roll 30 is reduced to almost zero (0) V.

If the electric-field adjusting conductive member 51 is not used, the potential difference of 1 kV or higher is present between the surface of the inside secondary transfer roll 29 and the surface of the outside secondary transfer roll 30, and an electric field that is directed from the surface of the outside secondary transfer roll 30 toward the surface of the inside secondary transfer roll 29 is formed in the sheet transport path (see a potential variation indicated by a bold broken line in the graph of FIG. 4).

When the earthed electric-field adjusting conductive member 51 is located at a predetermined position shown in FIG. 2, its potential is substantially equal to that on the surface of the outside secondary transfer roll 30. Therefore, a potential gradient (of the intensity of the electric field) on the sheet transport path is gentle (indicated by a bold slid line in the graph of FIG. 4).

Accordingly, the electric field that acts on the recording sheet after it passes the secondary transfer region (nip) Q4 is reduced in its intensity, while the electric field between the surface of the inside secondary transfer roll 29 and the electric-field adjusting conductive member 51 is correspondingly intensified (FIG. 4).

Where the resistance of the surface layer of the outside secondary transfer roll 30 is high, a portion of the surface of the outside secondary transfer roll 30, located apart from the secondary transfer region (nip) (Q4), is sometimes—several tens to several hundreds V. In this case, to secure a satisfactory image transfer performance, it is required to increase the whole application voltage. With increase of the application voltage, the surface potential of the inside secondary transfer roll 29 increases (in absolute value). Therefore, the relative potential difference is still of the order of 1 kV.

To suppress the electric field generation to eliminate the sheet unseparable state, voltage of—several hundreds V may be applied from a bias voltage source 54 to the electric-field adjusting conductive member 51 as shown in FIG. 2B, while the electric-field adjusting conductive member 51 is earthed in the above case. When the electric-field adjusting conductive member 51 is earthed, an electric field whose direction is opposite to that of the already existing one is developed. This electric field possibly gives rise to such a paper jam that the recording sheet attaches onto the outside secondary transfer roll 30. The necessity is to adjust the potential of the electric-field adjusting conductive member 51 so that the potential difference between it and the inside secondary transfer roll 29 is controlled to be within several hundreds V (in absolute value). Reduction of the potential difference to be within about 500V will be satisfactory for most cases. However, to secure a reliable separation of a thin sheet of small weight, it is desirable that the potential difference is reduced to be within about 300V.

The bias voltage source 54, which is connected as shown in FIG. 2B forms electric-field adjusting-potential applying means for applying a potential for weakening the electric field, which is developed between the outside secondary transfer roll 30 and the inside secondary transfer roll 29 in a region located downstream of the secondary transfer region Q4.

Next, a place where the electric-field adjusting conductive member 51 is to be located will be described.

Referring to FIG. 3, a is a distance, measured along the intermediate transfer belt B, from a point (releasing point) where the intermediate transfer belt B and the recording sheet are released from being nipped to the tip of the electric-field adjusting conductive member 51; b is the length of the electric-field adjusting conductive member 51 measured along the intermediate transfer belt B; c is a distance from the intermediate transfer belt B to the electric-field adjusting conductive member 51; and d is the thickness of the electric-field adjusting conductive member 51 measured in the direction perpendicular to the intermediate transfer belt B.

When the leading edge of the recording sheet having undergone the secondary image transfer and been charged leaves the nip and advances a distance of about 10 mm ahead of the nip, the recording sheet is lifted to the intermediate transfer belt B, resulting in the sheet unseparable problem. When taking account of this, the distance a is selected to be preferably 8 mm to 12 mm although the distance value depends on an lift angle of the intermediate transfer belt B. A distance value range of 14 mm to 18 mm is effective for most cases, but cannot prevent the separation of a thin sheet in high humidity condition. Where the distance a is 20 mm or longer, the electric-field adjusting conductive member 51 substantially loses its ability.

The distance b follows. In order that the recording sheet is discharged straight while overcoming the intensity of the electric field by its weight, the leading edge of the recording sheet must be separated at least 20 mm apart from the secondary transfer region Q4 although the distance value depends on the weight of the recording sheet. Further, the intensity of the electric field is much lowered in a region 20 mm apart from the secondary transfer region Q4. When considering those conditions, it is preferable that the distance b is selected so as to satisfy an equation of "a+b=20 mm". The distance b may be longer than this, as a matter of course.

The distance c and the thickness d may be properly selected so long as the electric-field adjusting conductive member 51 of the selected dimensions does not interfere with another member or members. Those dimensions affect a potential gradient between the electric-field adjusting conductive member 51 and the outside secondary transfer roll 30. However, it is better to understand that the selection of the dimensions c and d is limited substantially for reducing the distance a; minimization of the dimensions c and d leads to reduction of the dimension a.

From the above description, it is seen that the end of the electric-field adjusting conductive member 51 is put close to the secondary transfer region Q4 as far as circumstances permit by reducing the distance a. If the end of the electric-field adjusting conductive member 51 is extremely close to the secondary transfer region Q4, electric leakage will occur under high humidity condition. To avoid the leakage, an anti-leakage member (insulation shield member) 52 made of insulating material is provided between the electric-field adjusting conductive member 51 and the inside secondary transfer roll 29.

<Operation of Embodiment 1>

In the thus constructed image forming apparatus of the embodiment 1, a toner image is formed on the surface of the intermediate transfer belt (toner holding belt) B, which is rotatably supported by the support rollers including the inside transfer roll 29.

The outside transfer roll 30, which is disposed in opposition to the inside transfer roll 29 with respect to the toner image holding belt B develops a transfer region Q4 in a space between the roll 30 and the toner image holding belt B.

The sheet transport means 42 to 47 moves the recording sheet through the transfer region Q4 when the toner image on the toner image holding belt B passes through the transfer region Q4.

The transfer unit T2 including the inside transfer roll 29, the outside transfer roll 30 and the electrode roll 31 transfers the toner image from the toner image holding belt B onto the recording sheet that passes through the transfer region Q4 when transfer voltage is applied to between the inside transfer roll 29 and the outside transfer roll 30.

The electric-field adjust-potential applying means 53 (or 54) applies a potential, which weakens the electric field developed between the outside transfer roll 30 and the inside transfer roll 29 in a region located downstream of the transfer region Q4, to the electric-field adjusting conductive member 51 which is disposed in proximity to and along the inner side of the toner image holding belt B leaving the secondary transfer region Q4 at a position located downstream of the transfer region Q4.

Therefore, the electric field acting to move the recording sheet leaving the transfer region Q4 to the toner image holding belt B is weakened, and hence there is a little chance that the paper jam is caused by the clinging of the recording sheet to the toner image holding belt B.

<Embodiment 2>

Figure 5:
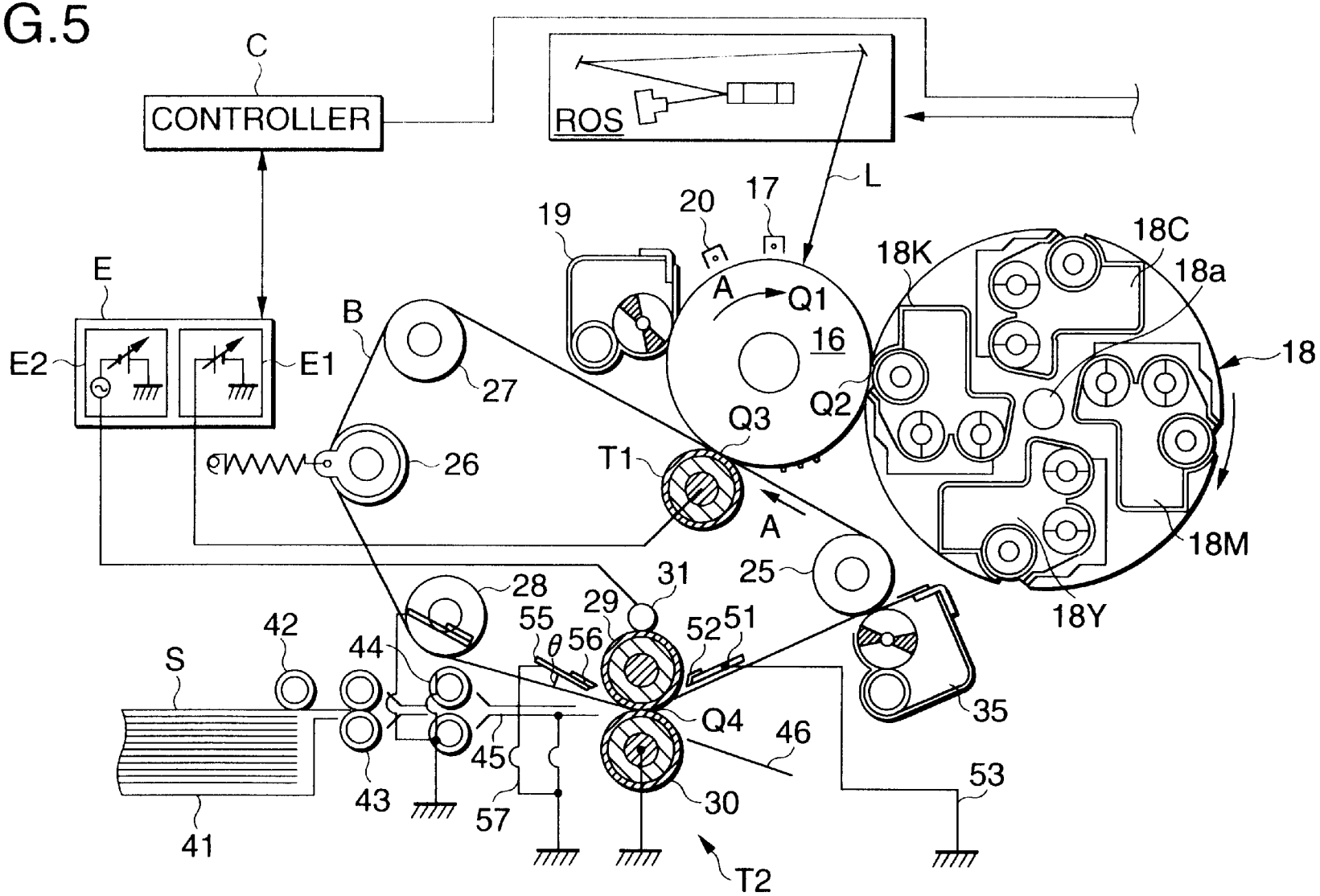
FIG. 5 is an enlarged view useful in explaining an embodiment 2 of the present invention, the view corresponding to FIG. 2 for the embodiment 1.

FIG. 5 is an enlarged view useful in explaining an embodiment 2 of the present invention, the view corresponding to FIG. 2 for the embodiment 1.

In the description of the embodiment 2, like or equivalent portions are designated by like reference numerals used in the description of the embodiment 1.

The embodiment 2 is substantially equal to the embodiment 1 except the following points.

As shown in FIG. 5, an electric-field-adjust conductive member 55 is located upstream of the secondary transfer unit T2. The construction and operation of the electric-field-adjust conductive member. 55 is exactly the same as those of the electric-field-adjust conductive member 51 in the embodiment 1. The electric-field-adjust conductive member 55 suppresses an electric field in a region located upstream of the secondary transfer region Q4. The downstream end of the electric-field-adjust conductive member 55 (facing the inside secondary transfer roll 29) is covered with an insulation anti-leakage member (insulation shield member) 56.

The electric-field-adjust conductive member 55 suppresses an excessive electric field present just before (upstream of) the secondary transfer region Q4 to prevent toner particles from scattering (already stated), but does not affect the separation of the recording sheet. The sheet guide member 45, which is also located upstream of (just before) the secondary transfer region Q4, and the electric-field-adjust conductive member 55, which is located on the inner side of the intermediate transfer belt (toner image holding belt) B, are both earthed. The earthing of those members eliminates a potential gradient is present between the sheet guide member 45 and the electric-field-adjust conductive member 55, and suppresses an excessive transfer electric field.

A conductive member 57 forms electric-field adjusting-potential applying means for applying a potential for weakening the electric field, which is developed between the outside secondary transfer roll 30 and the inside secondary transfer roll 29 in a region located upstream of the secondary transfer region Q4.

Conditions on the mounting of the electric-field-adjust conductive member 55 are substantially equal to those for the electric-field-adjust conductive member 51. In the embodiment 2, the electric-field-adjust conductive member 55 is slanted at an angle of θ with respect to the intermediate transfer belt B. This angle between the electric-field-adjust conductive member 55 and the intermediate transfer belt B, like the dimensions c and d, less influences the operation of the image forming apparatus. Therefore, the angle may be selected appropriately so long as the selected angle does not produce the interference of the electric-field-adjust conductive member 55 with another member or members and electric leakage problem. In this case, the angle is preferably set at a small value, as a matter of course, when taking account of the reduction of the dimension a.

<Third Embodiment>

Figure 6:
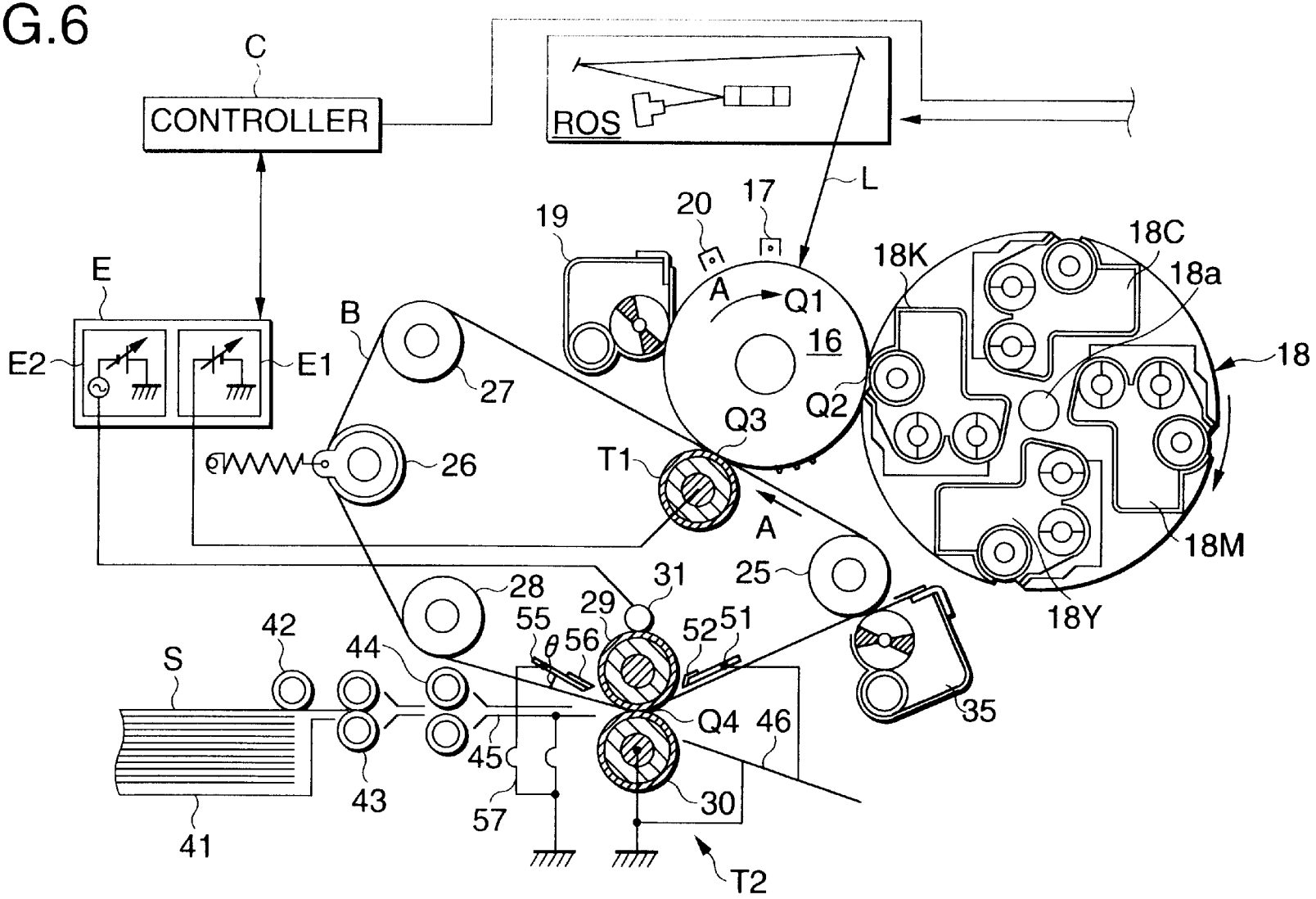
FIG. 6 is an enlarged view useful in explaining an embodiment 3 of the present invention, the view corresponding to FIG. 5 for the embodiment 2.

FIG. 6 is an enlarged view useful in explaining an embodiment 3 of the present invention, the view corresponding to FIG. 5 for the embodiment 2.

In the description of the embodiment 3, like or equivalent portions are designated by like reference numerals used in the description of the embodiment 2.

The embodiment 3 is substantially equal to the embodiment 2 except the following points.

As shown in FIG. 6, the sheet guide 46 for guiding a recording sheet which leaves the secondary transfer region Q4 and the electric-field-adjust conductive member 51 are both earthed to weaken the electric field that is developed by the inside secondary transfer roll 29 and the outside secondary transfer roll 30 in a region downstream of the secondary transfer region Q4. The earthing of the sheet guide 46 and the member 51 improves the release characteristics of the recording sheet.

<Fourth Embodiment>

Figure 7:
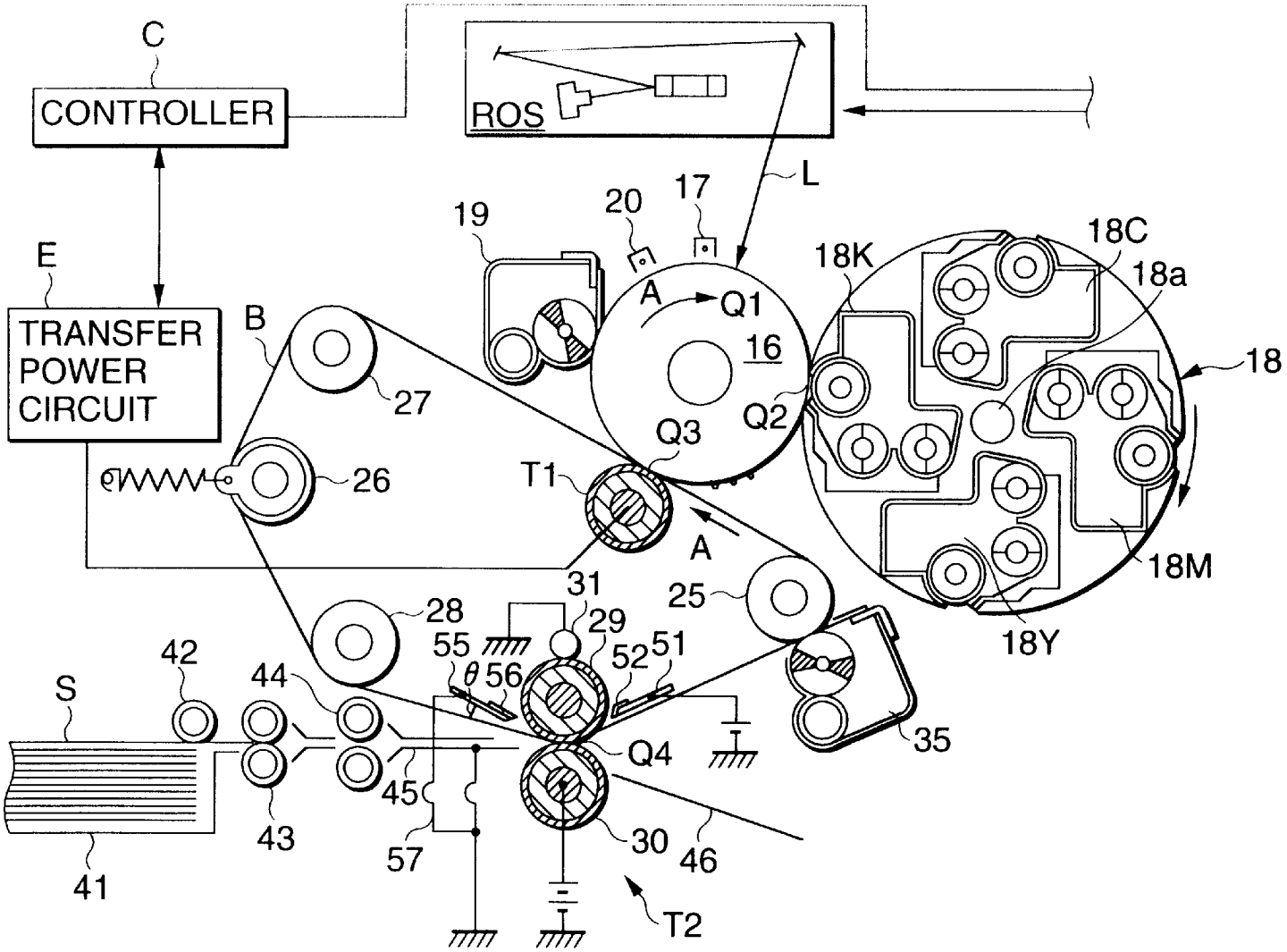
FIG. 7 is an enlarged view useful in explaining an embodiment 4 of the present invention, the view corresponding to FIG. 5 for the embodiment 2.

FIG. 7 is an enlarged view useful in explaining an embodiment 4 of the present invention, the view corresponding to FIG. 5 for the embodiment 2.

In the description of the embodiment 4, like or equivalent portions are designated by like reference numerals used in the description of the embodiment 2.

The embodiment 4 is substantially equal to the embodiment 2 except the following points.

As shown in FIG. 7, the electrode roll 31 is earthed, while a positive DC voltage as a bias voltage, e.g., +2 KV, is applied to the shaft of the outside secondary transfer roll 30, whereby a transfer electric field is developed. The electric field is developed between the inside secondary transfer roll 29 and the outside secondary transfer roll 30 in a region located downstream of the secondary transfer region Q4, as in the case of the embodiment 1. In this case, a potential on the surface of the outside secondary transfer roll 30 is positive in polarity and at several tens to several hundreds V.

For this reason, positive voltage of several hundreds V is applied to the electric-field-adjust conductive member 51 to suppress an electric field on the sheet transport path. With this, the electric field that is developed between the inside secondary transfer roll 29 and the outside secondary transfer roll 30 in a region located downstream of the secondary transfer region Q4, is reduced to improve the release characteristics of the recording sheet.

<Fifth Embodiment>

Figure 8A:
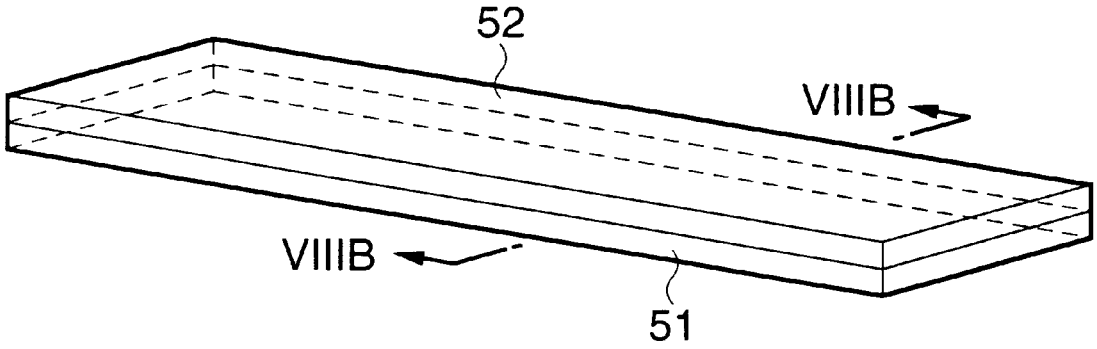
FIG. 8A is a perspective view showing the electric-field-adjust conductive member.
Figure 8B:
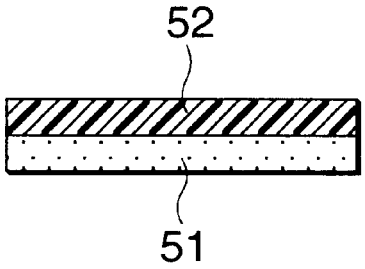
FIG. 8B is a cross sectional view taken on line VIIIb–VIIIB in FIG. 8A.
Figure 8C:
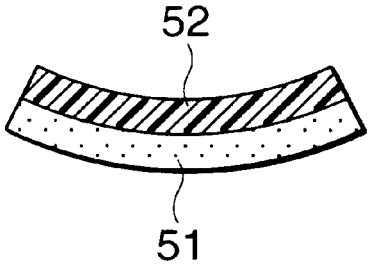
FIG. 8C is an explanatory diagram showing a modification of the electric-field-adjust conductive member of the fifth embodiment.
Figure 9A:
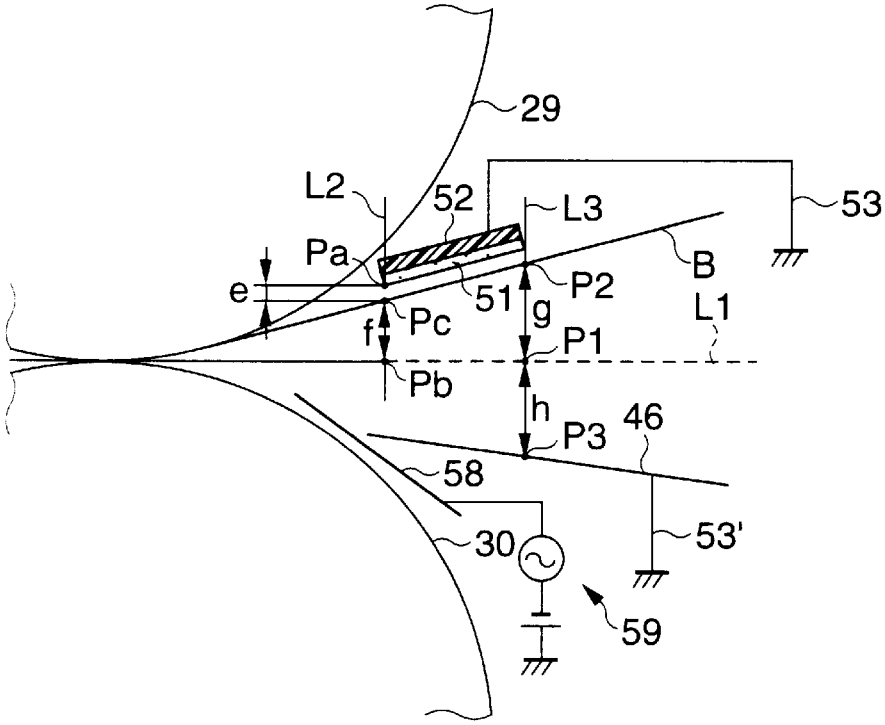
FIG. 9A is a perspective view showing a state of a structure, which includes the paired transfer rolls and the electric-field-adjust conductive member, immediately after the leading edge of the recording sheet passes through the secondary transfer region.
Figure 9B:
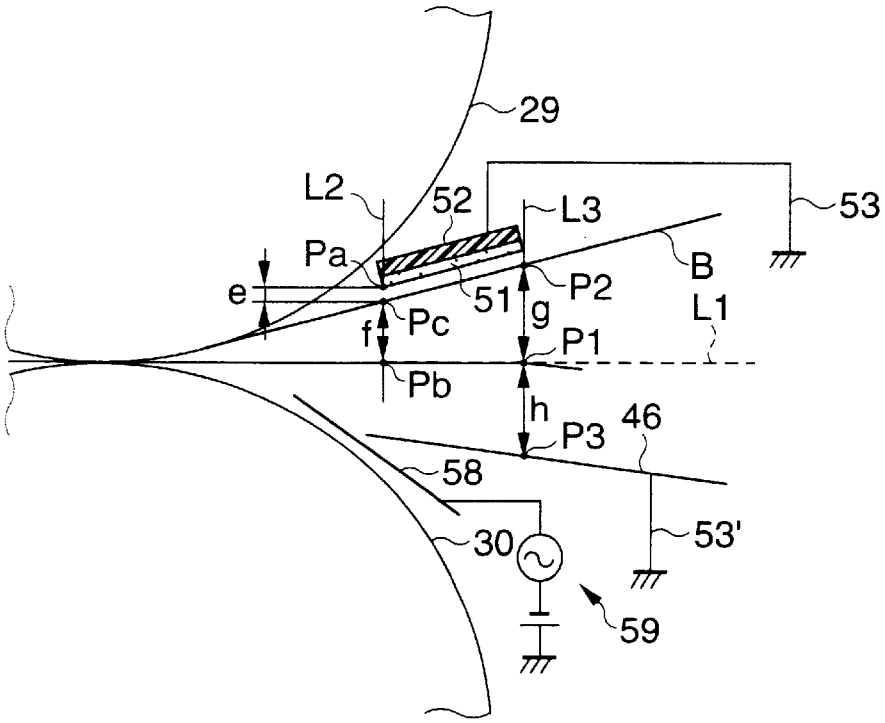
FIG. 9B is a perspective view showing a state of the structure when the leading edge of the recording sheet further advances from its position shown in FIG. 9A.

FIG. 8 is an explanatory diagram useful in explaining an electric-field-adjust conductive member in use with an image forming apparatus, which constitutes a fifth embodiment of the present invention. FIG. 8A is a perspective view showing the electric-field-adjust conductive member, FIG. 8B is a cross sectional view taken on line VIIIb–VIIIB in FIG. 8A, and FIG. 8C is an explanatory diagram showing a modification of the electric-field-adjust conductive member of the fifth embodiment. FIG. 9 is another explanatory diagram for explaining the electric-field-adjust conductive member and its related mechanical components. FIG. 9A is a perspective view showing a state of a structure, which includes the paired transfer rolls and the electric-field-adjust conductive member, immediately after the leading edge of the recording sheet passes through the secondary transfer region. FIG. 9B is a perspective view showing a state of the structure when the leading edge of the recording sheet further advances from its position shown in FIG. 9A.

In the description of the embodiment 5, like or equivalent portions are designated by like reference numerals used in the description of the embodiment 1.

The embodiment 5 is substantially equal to the embodiment 1 except the following points.

As shown in FIG. 8, an electric-field-adjust conductive member 51 is made of conductive foam, and bonded to an insulation resin plate (plate-like insulating member) 52. The insulation resin plate 52, rigid, is applied to the surface of the electric-field-adjust conductive member 51, which is opposite to its surface facing the intermediate transfer belt B. The electric-field-adjust conductive member 51 is made of resilient material so as not to damage the intermediate transfer belt B when it is brought into contact with the intermediate transfer belt.

The structure of the electric-field-adjust conductive member 51 and the insulation resin plate 52 shown in FIGS. 8A and 8B may be bent as shown in FIG. 8C. The bent structure accrues to the following merit. When the electric-field-adjust conductive member 51 is brought into contact with the intermediate transfer belt B, the bent surface, not the edge, of the structure smoothly comes in contact with the intermediate transfer belt B, to thereby lessen the force applied to the intermediate transfer belt B.

In FIG. 9, a detach saw 58 is disposed between the outside secondary transfer roll 30 and the sheet guide 46 and downstream of the secondary transfer region (Q4). A charge removing voltage is applied to the detach saw 58, from a charge removing power source 59.

In the figures, Pa is the upstream end of the electric-field-adjust conductive member 51, which is disposed in proximity to the inside secondary transfer roll 29; Pb is an intersection point where a straight line L1 coincident with the advancing direction of the recording sheet emanating from the secondary transfer region Q4 intersects a straight line L2 that passes through the upstream end Pa and is perpendicular to the straight line L1; Pc is an intersection point where the straight line L2 intersects the intermediate transfer belt B; e is a distance between the upstream end Pa and the intersection point Pc; and f is a distance between the intersection point Pb and the intersection point Pc. The inside secondary transfer roll 29, the outside secondary transfer roll 30 and the electric-field-adjust conductive member 51 are arranged so as to satisfy $e \leqq f$.

Further, in FIG. 9, P1 is an intersection point where the straight line L1 coincident with the advancing direction of the recording sheet emanating from the secondary transfer region Q4 intersects a straight line L3 which is prolonged from the downstream end of the electric-field-adjust conductive member 51, which is far away from the inside secondary transfer roll 29, in the direction perpendicular to the straight line L1; P2 is an intersection point where the straight line L3 intersects the intermediate transfer belt B; g is a distance between the intersection points P1 and P2; and h is a distance between the intersection points P1 and P3. The inside secondary transfer roll 29, the outside secondary transfer roll 30, the electric-field-adjust conductive member 51, and the downstream sheet guide 46 are arranged so as to satisfy h≦g.

<Operation of Embodiment 5>

Even in such a mechanical arrangement that the electric-field-adjust conductive member 51 is disposed close to the inside secondary transfer roll 29, no discharge occurs between the member 51 and the roll 29 since the insulation resin plate 52, rigid, is applied to the surface of the electric-field-adjust conductive member 51, which is opposite to its surface facing the intermediate transfer belt B. The rigid insulation resin plate 52, because of its rigidity, can support the elastic, electric-field-adjust conductive member 51 at a predetermined location.

The mechanical components which are arranged so as to satisfy h≦g (FIG. 9) accrues to the following merits. In a situation where the recording sheet leaves and advances along the straight line L1 and its leading edge reaches the straight line L2, the distance between the leading edge of the recording sheet and the intermediate transfer belt B is longer than the distance between the intermediate transfer belt B and the electric-field-adjust conductive member 51. Where the intermediate transfer belt B is charged, the charge of electricity migrates through the shorter space between the intermediate transfer belt B and the electric-field-adjust conductive member 51. Therefore, an electric field present in the longer space (i.e., between the leading edge of the recording sheet and the intermediate transfer belt B) is small.

Under this condition, a small electrostatic force exerts on the recording sheet, from the intermediate transfer belt B, and hence the intermediate transfer belt B is hard to attract the recording sheet to it.

In FIG. 9, the sheet guide 46 for guiding the recording sheet leaving the secondary transfer region Q4 is disposed so as to satisfy h≦g. This produces the following merit.

In a situation where the recording sheet leaves and advances along the straight line L1 and its leading edge reaches the straight line L3, the distance between the leading edge of the recording sheet and the intermediate transfer belt B is longer than the distance between the leading edge of the recording sheet and the downstream sheet guide 46. Therefore, the recording sheet is under the influence of an electric field present in the shorter space between the recording sheet and the sheet guide 46 rather than an electric field present in the longer space between the recording sheet and the intermediate transfer belt B.

Therefore, there is a little chance that the intermediate transfer belt B electrostatically attracts the recording sheet to it, and hence that the recording sheet clings to the intermediate transfer belt B, resulting paper jam.

<Modification>

While some specific embodiments of the present invention have been described, it should be understood that the invention is not limited to those specific embodiments, but may variously be modified, changed and altered within the true spirits of the invention. In this connection, some examples are given hereunder.

(H01) The invention may be applied to a tandem type image forming apparatus in which a plural number of image holding or bearing members are used, and an intermediate transfer belt successively passes through primary transfer regions set up in the belt moving paths of the surfaces of those image holding members.

(H02) The invention may be applied to an image forming apparatus which uses a photosensitive belt in place of the intermediate transfer belt B. In this case, the transfer unit for transferring a toner image from the photosensitive belt onto a recording sheet is not a secondary transfer unit.

(H03) The outside secondary transfer roll 30 used in each of the embodiments 1 to 4 may be substituted by a transfer member of the corotron type or the pad type.

The image forming apparatus thus constructed according to the present invention brings about the following meritorious effects:

(E01) to stably separate the recording sheet from the toner image holding belt, not using the charge remover requiring a high tension power source;

(E02) to stably separate the recording sheet from the toner image holding belt, not locating a member that possibly obstructs the transportation of the recording sheet on the sheet transporting path; and (E03) to stably separate the recording sheet from toner image holding belt independently of ambient conditions and sheet characteristics.

What is claimed is:

1. An image forming method comprising the steps of:

developing a toner image on a photosensitive member;

forming a toner image on a toner image holding belt rotatably supported by a plural number of rolls including an inside transfer roll;

moving a recording sheet through a transfer region when a toner image on said toner image holding belt passes through said transfer region;

transferring the toner image from said toner image holding belt onto the recording sheet passing through said transfer region when voltage is applied to between said inside transfer roll and an outside transfer member, which is disposed in opposition to said inside transfer roll with respect to said toner image holding belt;

adjusting an electric-field using an electric-field conductive member located downstream of the transfer region, the electric-field conductive member disposed in proximity to and along the inner side of the toner image holding belt leaving the transfer region at a position located downstream of the transfer region; and applying a potential which weakens an electric-field developed between the outside transfer member and the inside transfer roll in a region located downstream of the transfer region, to the electric-field adjusting conductive member.

2. An image forming apparatus comprising:

(A01) a toner image holding belt rotatably supported by a plural number of rolls including an inside transfer roll, a toner image being formed on the surface of said toner image holding belt;

(A02) an outside transfer member, which is disposed in opposition to said inside transfer roll with respect to said toner image holding belt develops a transfer region in a space between said outside transfer member and said toner image holding belt;

(A03) sheet transport means for moving a recording sheet through said transfer region when a toner image on said toner image holding belt passes through said transfer region;

(A04) a transfer unit including said inside transfer roll and said outside transfer member transfers the toner image from said toner image holding belt onto the recording sheet that passes through said transfer region when transfer voltage is applied to between said inside transfer roll and said outside transfer member;

(A05) electric-field adjusting conductive member for adjusting an electric field present downstream of said transfer region, said electric-field-adjust conductive member being disposed in proximity to and along the inner side of said toner image holding belt leaving said transfer region at a position located downstream of said transfer region; and (A06) electric-field adjust-potential applying means applies a potential, which weakens an electric field developed between said outside transfer member and said inside transfer roll in a region located downstream of said transfer region, to said electric-field adjusting conductive member.

3. The image forming apparatus according to claim 2, further comprising:

(A07) an insulation shield member covering the end of said electric-field-adjust conductive member, which is closer to and faces said inside transfer roll.

4. An image forming apparatus comprising:

(B01) a toner image holding belt rotatably supported by a plural number of rolls including an inside transfer roll, a toner image being formed on the surface of said toner image holding belt;

(B02) an outside transfer member, which is disposed in opposition to said inside transfer roll with respect to said toner image holding belt develops a transfer region in a space between said outside transfer member and said toner image holding belt;

(B03) sheet transport means for moving said recording sheet through said trans fer region when a toner image on said toner image holding belt passes through said transfer region;

(B04) a transfer unit including said inside transfer roll, said outside transfer member and said electrode roll transfers the toner image from said toner image holding belt onto the recording sheet that passes through said transfer region when transfer voltage is applied to between said inside transfer roll and said outside transfer member;

(B05) electric-field adjusting conductive member for adjusting an electric field present upstream of said transfer region, said electric-field-adjust conductive member being disposed in proximity to and along the inner side of said toner image holding belt just before said transfer region; and (B06) electric-field adjust-potential applying means applies a potential, which weakens an electric field developed between said outside transfer member and said inside transfer roll in a region located upstream of said transfer region, to said electric-field adjusting conductive member.

5. The image forming apparatus according to claim 4, further comprising:

(B07) an insulation shield member covering the end of said electric-field-adjust conductive member, which is closer to and faces said inside transfer roll.

6. An image forming apparatus comprising:

(C01) a toner image holding belt rotatably supported by a plural number of rolls including an inside transfer roll, a toner image being formed on the surface of said toner image holding belt;

(C02) an outside transfer member, which is disposed in opposition to said inside transfer roll with respect to said toner image holding belt develops a transfer region in a space between said outside transfer member and said toner image holding belt;

(C03) sheet transport means for moving a recording sheet through said transfer region when a toner image on said toner image holding belt passes through said transfer region;

(C04) a transfer unit including said inside transfer roll and said outside transfer member transfers the toner image from said toner image holding belt onto the recording sheet that passes through said transfer region when transfer voltage is applied to between said inside transfer roll and said outside transfer member;

(C05) elastic, electric-field adjusting conductive member for adjusting an electric field present downstream of said transfer region, said electric-field-adjust conductive member being disposed in contact with or in proximity to and along the inner side of said toner image holding belt leaving said transfer region at a position located downstream of said transfer region; and (C06) electric-field adjust-potential applying means applies a potential, which weakens an electric field developed between said outside transfer member and said inside transfer roll in a region located downstream of said transfer region, to said electric-field adjusting conductive member.

7. The image forming apparatus according to claim 6, further comprising:

(C07) a rigid, plate-like insulating member, applied to the surface of said electric-field-adjust conductive member, which is opposite to its surface facing said image holding belt.

8. The image forming apparatus according to claim 6, wherein (C08) said inside transfer roll, said outside transfer member and said electric-field-adjust conductive member are arranged so as to satisfy $e \leqq f$, where Pa: the upstream end of said electric-field-adjust conductive member, which is disposed in proximity to said inside transfer roll Pb: intersection point where a straight line L1 coincident with the advancing direction of a recording sheet emanating from said transfer region intersects a straight line L2 that passes through the upstream end Pa and is perpendicular to the straight line L1

Pc: intersection point where the straight line L2 intersects said image holding belt;

e: distance between the upstream end Pa and the intersection point Pc f: distance between the intersection point Pb and the intersection point Pc.

9. The image forming apparatus according to claim 6, further comprising:

(C09) a downstream sheet guide, disposed downstream of said transfer region, for guiding a recording sheet leaving said transfer region, and wherein (C10) said inside transfer roll, said outside transfer member, said electric-field-adjust conductive member, and said downstream sheet guide are arranged so as to satisfy $h \leqq g$, where P1: intersection point where the straight line L1 coincident with the advancing direction of the recording sheet emanating from said transfer region intersects a straight line L3 which is prolonged from the downstream end of said electric-field-adjust conductive member, which is far away from said inside transfer roll, in the direction perpendicular to the straight line L1

P2: intersection point where the straight line L3 intersects the image holding belt g: distance between the intersection points P1 and P2 h: distance between the intersection points P1 and P3.

* * * * *